US006915980B2

(12) United States Patent
Tsuruga

(10) Patent No.: US 6,915,980 B2
(45) Date of Patent: Jul. 12, 2005

(54) WINDING AND CUTTING MACHINE FOR ROLLED PAPER

(75) Inventor: Yasutaka Tsuruga, Osaka (JP)

(73) Assignee: Hanshin Horo Co., Ltd., Osaka (JP)

( * ) Notice: Subject to any disclaimer, the term of this patent is extended or adjusted under 35 U.S.C. 154(b) by 30 days.

(21) Appl. No.: 10/376,316

(22) Filed: Mar. 3, 2003

(65) Prior Publication Data

US 2003/0164420 A1 Sep. 4, 2003

(30) Foreign Application Priority Data

Mar. 4, 2002 (JP) ..... 2002-057811

(51) Int. Cl.[7] ..... B65H 35/08

(52) U.S. Cl. ..... 242/526; 242/535.2; 242/537; 242/538.1; 242/547; 108/108

(58) Field of Search ..... 242/526, 535.2, 242/537, 538, 547, 538.1; D6/512, 514, 569, 574; 108/108

(56) References Cited

U.S. PATENT DOCUMENTS

| | | | | | |
|---|---|---|---|---|---|
| 945,280 | A | * | 1/1910 | Lindberg | 248/242 |
| 2,105,707 | A | * | 1/1938 | Stancliff | 242/527.5 |
| 3,115,254 | A | * | 12/1963 | Dowdall | 211/134 |
| 3,598,333 | A | * | 8/1971 | Beeman et al. | 242/533.6 |
| 3,871,594 | A | * | 3/1975 | O'Neil et al. | 242/526 |
| 4,934,645 | A | * | 6/1990 | Breslow | 248/242 |
| 6,651,922 | B1 | * | 11/2003 | Quimpo | 242/526 |

* cited by examiner

*Primary Examiner*—John Q. Nguyen
(74) *Attorney, Agent, or Firm*—Armstrong, Kratz, Quintos, Hanson & Brooks, LLP

(57) ABSTRACT

A winding and cutting machine for rolled paper provided with a roller shaft holding a roll from an inner side, a feeding roller and a feeding aid roller to hold and pull the paper for a predetermined length, and a fixed cutting blade disposed between the feeding roller and a winding rotational body which is constructed as to press the paper to the fixed cutting blade into the predetermined length by winding the paper and giving tensile force to the paper.

3 Claims, 19 Drawing Sheets

WINDING AND CUTTING MACHINE FOR ROLLED PAPER

BACKGROUND OF THE INVENTION

1. Field of the Invention

This invention relates to a winding and cutting machine for rolled paper.

2. Description of the Related Art

Conventionally, a machine to cut and fold paper of a predetermined length from a roll (such as a roll of toilet paper) does not exist, and these works are conducted by hands. That is to say, the paper is drawn out of the roll set on a holder by one hand with eye-estimation, an upper cover of the holder is held by another hand, the drawn-out paper is pulled to be cut, and the cut paper is folded in appropriate width and number of sheets to use.

However, in the conventional manual work, the paper is not necessarily cut at perforation lines on the roll of which interval is about 23 cm, drawn amount of the paper varies because the perforation lines are hard to find, the folding width and number of sheets are unstable, and the processes cause labor.

It is therefore an object of the present invention to provide a winding and cutting machine for rolled paper with which paper of a predetermined length from a roll is wound flat, folded, and cut as to be in predetermined folding width and number of sheets.

BRIEF DESCRIPTION OF THE DRAWINGS

The present invention will be described with reference to the accompanying drawings in which.

DESCRIPTION OF THE PREFERRED EMBODIMENTS

Figure 1:
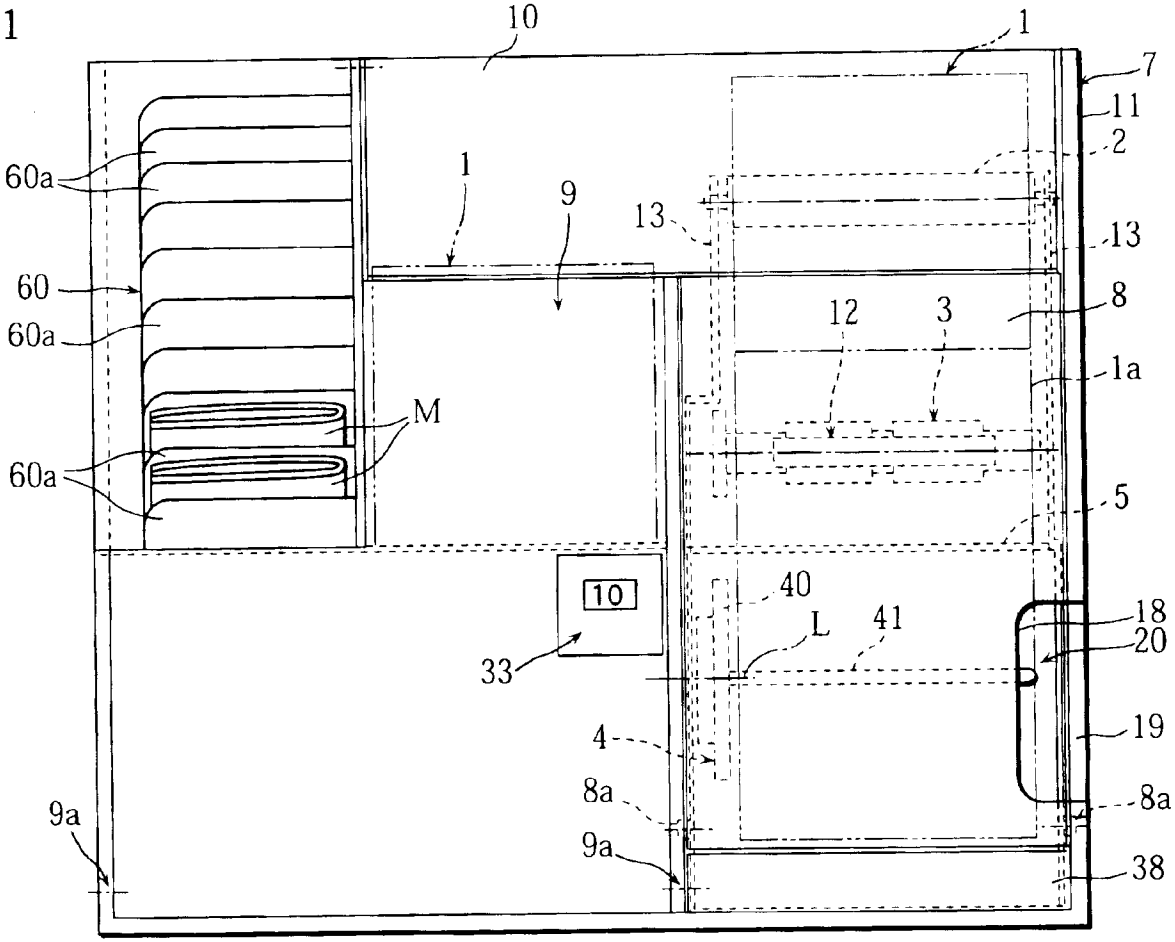
FIG. 1 is a front view showing an embodiment of the present invention.
Figure 2:
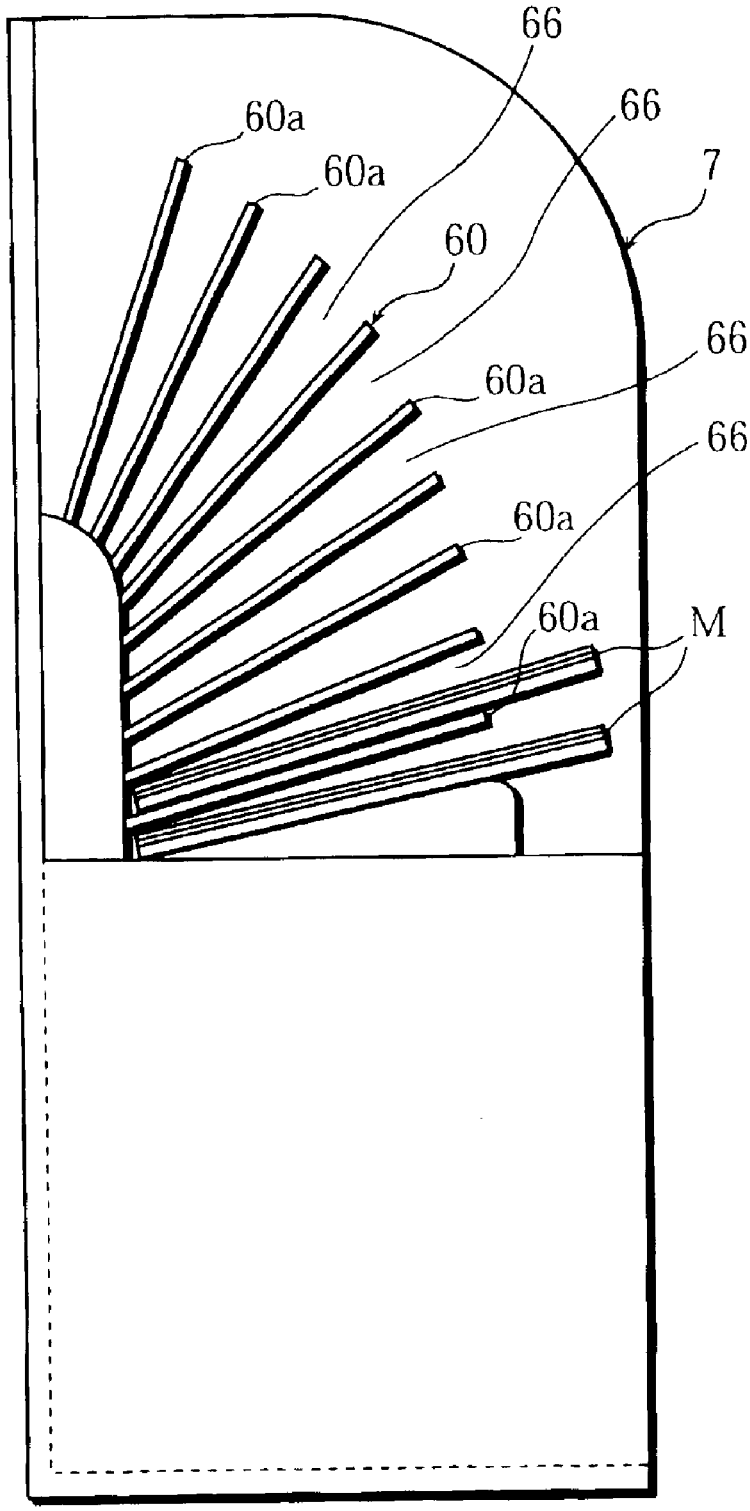
FIG. 2 is a left side view.

Preferred embodiments of the present invention will now be described with reference to the accompanying drawings.

A winding and cutting machine for rolled paper relating to the present invention, as shown in FIGS. 1 through 5, is provided with a roller shaft 2 holding a roll 1 of paper from an inner side, a feeding roller 3 and a feeding aid roller 12 to hold paper 1*a* of the roll 1 and draw out for a predetermined length, a winding rotational body 4 to wind the drawn-out paper 1*a* of the predetermined length in a flat and folded state, and a fixed cutting blade 5 disposed between the feeding roller 3 and the winding rotational body 4 which is constructed as to press the paper 1*a* to the fixed cutting blade 5 to cut into the predetermined length by winding the paper 1*a* and giving tension to the paper 1*a*.

Figure 14:
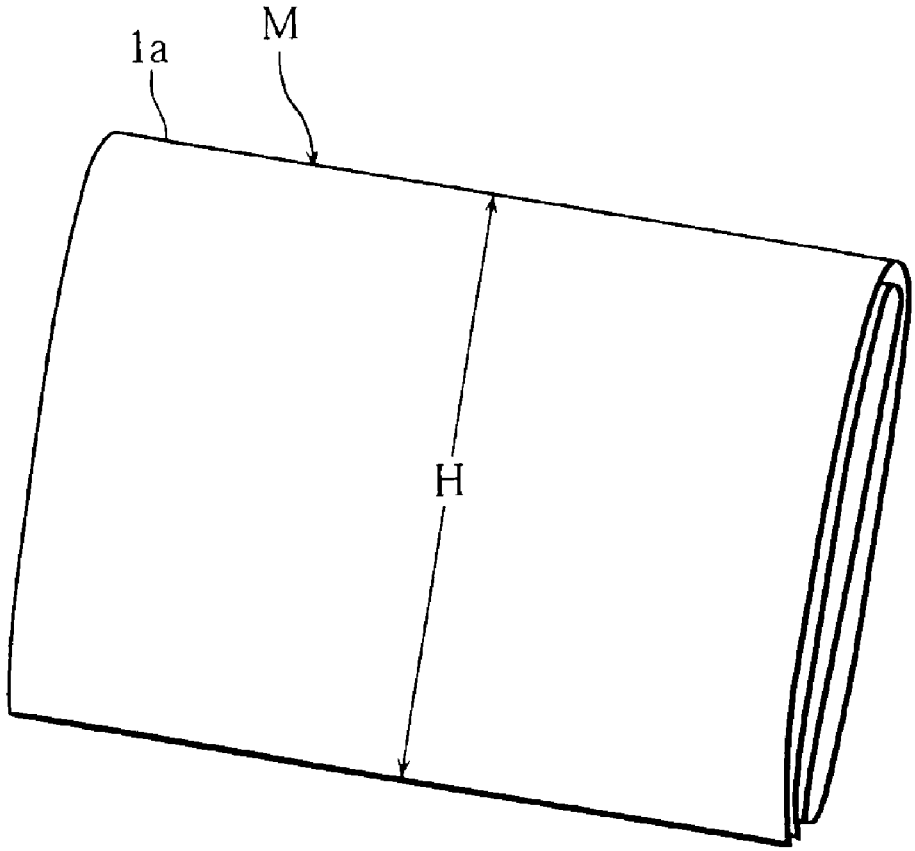
FIG. 14 is a perspective view showing formed paper.

And, formed paper M, formed by the winding rotational body 4 winding the paper 1*a* of the predetermined length in flat and folded state, is ready to use as shown in FIG. 14, and folding width H of the formed paper M is preferably 70 mm to 100 mm for comfortable use.

This winding and cutting machine is provided with an (cubic) outer case 7, an operation door 8 (on the right side) is attached to a front face of the outer case 7 through left and right hinge portions 8*a* (on a lower side) as to freely oscillate around a horizontal axis and open forward (on an upper side), and a maintenance door 9 (on the left side) is attached to the front face of the outer case 7 through left and right hinge portions 9*a* (on the lower side) as to freely oscillate around a horizontal axis and open forward (on an upper side). And, devices inside the outer case 7 such as a leakage breaker can be operated when the maintenance door 9 is opened. And, the operation door 8 is hitched to the outer case 7 with a hitching piece 8*b* as an upper part of the operation door 8 is freely attached and detached to the outer case 7.

And, an upper cover 10 is attached to an upper face of the outer case 7 as to freely oscillate around a horizontal axis and open upward. The roll 1 can be set in the outer case 7 to be used with opening the upper cover 10, and spare rolls 1 can be stored in the outer case 7. A rear face of the outer case 7 is attached to a wall of a toilet booth, etc. (not shown in figures).

A stock case 60, which holds 5 to 10 units of formed paper M, is attached to a left side of the outer case 7. To describe concretely, the stock case 60 has plural (10 in the present embodiment) shelf boards 60*a* disposed like spokes of a wheel in a side view to store the formed paper M in storing portions 66 formed by the neighboring shelf boards 60*a*. This construction can dispose many shelf boards 60*a* (many storing portions 66) to store many units of the formed paper M in a small space. The stock case 60 may be constructed with the plural shelf boards 60*a* disposed horizontal to make horizontal shelves. In other words, neighboring shelf boards 60*a* are disposed at locations at which the distance between the shelf boards 60*a* increases from the base end to the forward end or parallel observed in a side view, and the storing portion 66 is widened toward the opening direction or parallel.

Both ends of the roller shaft 2 are connected to upper parts of left and right fixation plates 13 in the outer case 7 to rotate the roll 1 held by the roller shaft 2 inserted in the roll 1 around a horizontal axis (along with the roller shaft 2).

The roll 1, such as a roll of toilet paper, is set in the outer case 7 by that the upper cover 10 of the outer case 7 is raised to take out the roller shaft 2, the roller shaft 2 is inserted to the roll 1, and the roller shaft 2 is attached again to the left and right fixation plates 13. This setting method is same as a conventional method to make conventional manual use possible in case of error of the machine and power outage. That is to say, in case of manual use, the upper cover is raised, the paper 1*a* is drawn out to the front side of the operation door 8, the upper cover 10 is closed to hold the paper 1*a* between the upper cover 10 and an upper edge of the operation door 8, and the paper 1*a* is cut as in the conventional use (cutting).

The feeding roller 3 is disposed below the roller shaft 2 and attached to the left and right fixation plates 13 in the outer case 7 as to rotate around a horizontal axis, and the roller 3 is rotated by a feeding motor 21 (with a reducer) disposed behind the roller 3 with a motor gear 22 engaged with a roller gear 3*a* of the roller 3.

And, the feeding aid roller 12 is disposed as to face the roller 3 and come close to and part from the roller 3 for holding the paper 1*a* of the roll 1 with appropriate contact pressure and drawing the paper 1*a* downward.

To describe concretely, a shaft portion of the aid roller 12 is held by long holes 6*a* (in back-and-forth direction) of attachment plates 6 attached to a rear face (inner face) of the operation door 8 as to freely move within the long holes 6*a*, and always elastically pushed toward the roller 3 by an elastic member (such as a compression spring). The aid roller 12 contacts the roller 3 with appropriate pressure in a closed state of the operation door 8 before operation. The operation door 8 can sufficiently maintain the closed state because only the pressing force of the aid roller 12 to the roller 3 (the elastic force of the elastic member 62) works as to push the operation door 8 from inside toward the front side, and no other mechanical forces work on the operation door 8. And, the operation door 8 and the aid roller 12 are omitted in FIG. 4.

Contact (holding) portion of the roller 3 and the aid roller 12 on the paper 1*a* is set on a central portion of the width of the paper and approximately ⅔ of the width (70 mm to 90 mm) for good stability of the paper 1*a* when suspended (that is to say, the left half and the right half of the paper 1*a* are suspended uniformly).

The diameter $D_1$ of the roller 3 is preferably 25 mm to 35 mm because control is facilitated when the periphery of the roller 3 is the same as folding width H of the formed paper M (refer to FIG. 14). And, the paper 1*a* is sent out for the same length as the folding width H of the formed paper M by one rotation of the motor gear 22 by setting the gear ratio of the motor gear 22 to the roller gear 3*a* to be 1:1.

A counter dowel 31 protrudes from a part near the periphery of the motor gear 22, contacts a counter switch 32 disposed behind the motor gear 22 (pushes the counter switch 32 once for each rotation of the motor gear 22). The feeding motor 21 stops after rotations of the motor gear 22 of a predetermined number to make drawing amount of the paper 1*a* accurate. And, the counter switch 32 is provided with counter control, connected to a count setting portion 33 on the maintenance door 9 shown in FIG. 1 to decide the rotation number of the feeding roller 3. The count setting portion 33 is to decide the amount of the paper 1*a* (number of folded sheets) wound to be folded by the winding rotational body 4.

The peripheral face of the roller 3 is formed coarse to certainly draw the paper 1*a* because the contact area with the paper 1*a* is small. For example, many small protrusions are disposed on the peripheral face of the roller 3, or the peripheral face of the roller 3 is formed like a gear. Instead of the roller 3, or with the roller 3, the peripheral face of the aid roller 12 may be made coarse.

A groove 14 in the peripheral direction is formed on a central portion of the peripheral face of the roller 3, insertion pieces 15*a* of a feeding guide 15 (of flat plate) disposed below the roller 3 are vertically inserted from the lower side to the groove 14 and the both sides of the roller 3, and the paper 1*a*, drawn out by the rollers 3 and 12, can be certainly led toward the lower side without interruption by the fixed cutting blade 5 disposed below the roller 3. That is to say, the drawn-out paper 1*a*, normally curling inward (backward) for rolling, is prevented from getting inside by the feeding guide 15 disposed on inner to the paper 1*a*.

The feeding guide 15 is, for example, attached to the left and right fixation plates 13 with a shaft portion 15*b* in horizontal direction disposed at central position in vertical direction of the feeding guide 15 as to be oscillatable. Another feeding guide 15 may be disposed on an outer side (front side) of the paper 1*a*. And, the feeding guide 15 is preferably formed with metal or a material which generates little static electricity to prevent the paper 1*a* from sticking by static electricity.

Figure 6A:
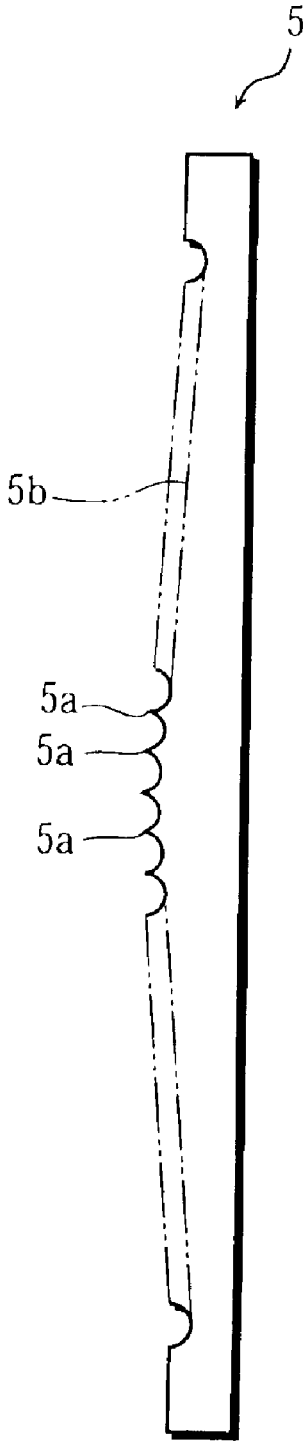
FIG. 6A is a top view showing a fixed cutting blade.
Figure 6B:
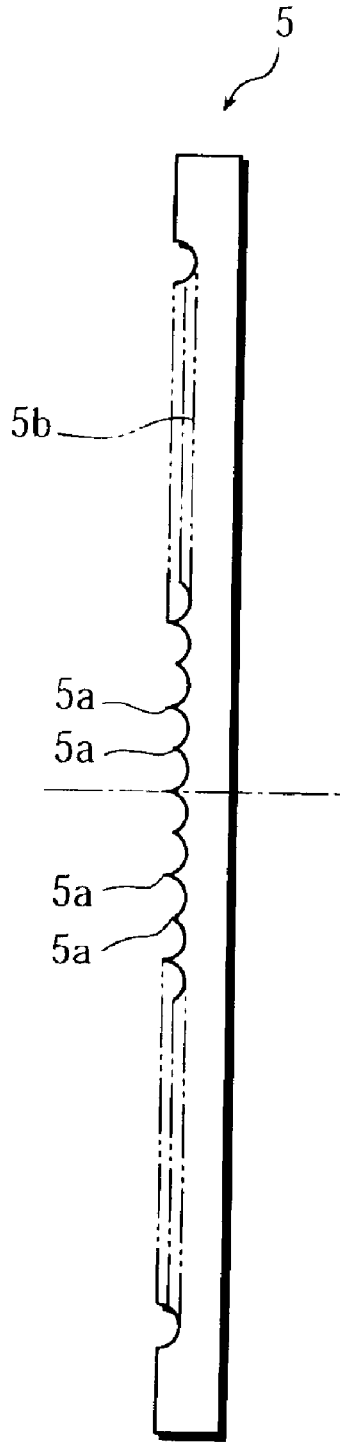
FIG. 6B is a top view showing the fixed cutting blade.

The fixed cutting blade 5 is formed into a belt slightly larger than the width of the paper 1*a*, disposed in a position below the feeding guide 15 as an edge in a longitudinal direction faces the paper la side (front side), and both sides of the fixed cutting blade 5 are attached to the fixation plates 13. The fixed cutting blade 5 may have a construction in which many teeth 5*a* of the same size are disposed on the edge 5*b* of which central portion in longitudinal direction is protruding (mounted) as shown in FIG. 6A, or, large teeth 5*b* and small teeth 5*b* are disposed in turn on a flat edge 5*b*. With this construction, the paper 1*a* having a thickness such as a double paper can be cut. And, a concave portion between the neighboring teeth 5*a* is preferably arc-shaped to decrease entanglement of fibers of the paper 1*a* in cutting and generation of dust.

The winding rotational body 4 is disposed below the fixed cutting blade 5 and provided with a rotation plate 40 and two (round) folding bars 41 disposed symmetric to an axis L of the rotation plate 40. The winding rotational body 4 is constructed as to wind the paper 1*a*, between the two folding bars 41, into a flat and folded state.

Figure 7A:
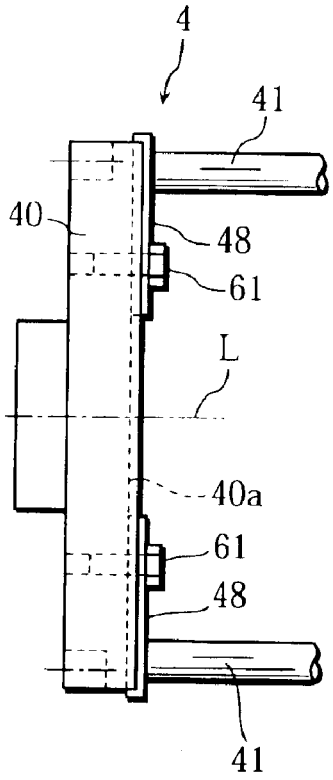
FIG. 7A is a construction-explanatory view showing a winding rotational body.
Figure 7B:
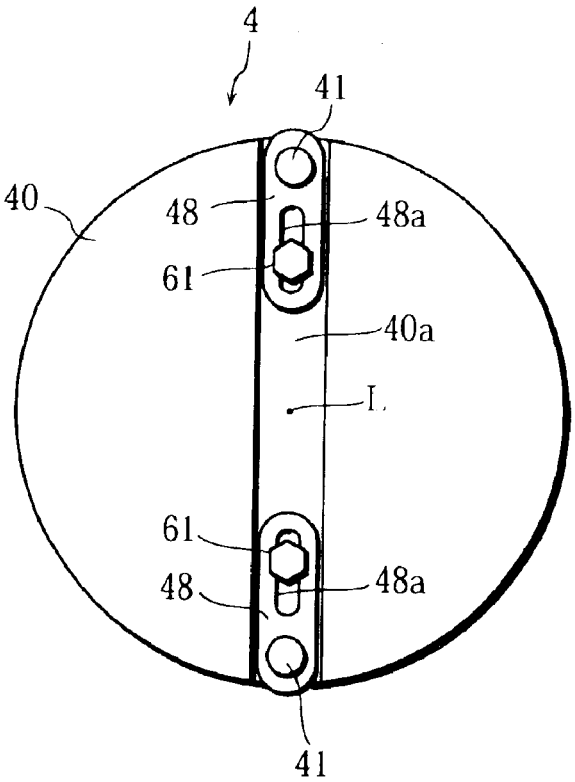
FIG. 7B is a construction-explanatory view showing the winding rotational body.

In the winding rotational body 4, as shown in FIGS. 7A and 7B, for example, a base plate portion 48 is attached to base ends of the folding bars 41. A long hole 48*a* (in diameter direction) is formed on the base plate portion 48. The base plate portion 48 is attached to the rotation plate 40 through a fastener 61 (such as a bolt) inserted to the long hole 48*a*, and the two folding bars 41 constituting a wind-up portion are adjustable to come close to and part from each other. A recessed groove 40*a* (having width of about 1 mm) to which the base plate portions 48 fit in diameter direction, and the base plate portions 48 are stably fixed to the rotation plate 40. And, the fastener 61 is freely screwed to a tapped hole going through the rotation plate 40.

The interval of the two folding bars 41 is set as to wind the paper 1*a* sent out by two rotations of the feeding roller 3 with one rotation to decide the folding width H of the formed paper M (refer to FIG. 14) wound by the two folding bars 41.

the rotation plate 40 is attached to the side plate 11 (the fixation plate 13) on the left side of the outer case 7 as to rotate around the horizontal axis L, and rotated by a folding motor 23 (with a reducer) disposed behind the rotation plate 40 with a motor gear 24 engaged with a gear formed on a peripheral face of the rotation plate 40.

The gear ratio of the motor gear 24 of the folding motor 23 to the gear on the rotation plate 40 is set to be 1:2 to make the number of folds by the winding rotational body 4 one for each rotation of the motor gear 24. In case of the paper 1*a* has certain thickness or strength such as a double paper, it is also preferable to repeat a movement in which the rotation plate 40 is rotated reversely for about 90° (after a pause) and rotated again in the former direction.

Further, a stopping dowel 52 protrudes from a part near the periphery of the motor gear 24. The stopping dowel 52 contacts a stopping switch 53 disposed above the folding motor 23 to stop the rotation plate 40 (the folding motor 23) at a position that a direction connecting the two folding bars 41 makes an angle of 0° to 15° with the horizontal face. This set angle is (as described later) to increase contact time of the paper 1*a* wound around the folding bars 41 with a wind-up portion 47.

Although a motor having dimensions of 42 mm×42 mm observed in the axis L direction and output of 1W is sufficient for the feeding motor 21 and the folding motor 23 when the roll 1 is a roll of toilet paper, when the roll 1 is a roll of paper towel in new standard, a motor having dimensions of 60 mm×60 mm observed in the axis L direction and output of 4W is sufficient.

A generator 44 which generates signals such as of light, electric wave, etc. is disposed on a lower position behind the rotational body 4, a receiver 45 for stopping the winding is disposed on a lower position in front of the rotational body 4, a receiver 46 for starting the driving is disposed on an upper position in front of the rotational body 4, and the generator 44 generates signals to the receiver 45 for stopping the winding and the receiver 46 for starting the driving simultaneously. Or two generators 44, each of which is for the receiver 45 and the receiver 46 respectively, may be disposed.

The receiver 45 for stopping the winding sends a signal to the stopping switch 53 when a signal is received from the generator 44, and the rotation plate 40 (the folding motor 23) is stopped when the stopping dowel 52 pushes the stopping switch 53 just after the signal is received. It is preferable to stop the winding rotational body 4 after 1 to 2 additional rotations with timer control etc., because the paper wound-up further.

The receiver 46 for starting the driving sends a signal to the motor 21 when a signal is received from the generator 44 to rotate the feeding roller 3 again for drawing out the paper 1*a*.

The folding bars 41 are disposed as to contact the whole area of lateral width of the paper 1*a*, and the paper 1*a* (the formed paper M) wound by the folding bars 41 is taken out of an opening portion 20, formed by a notched portion 18 on the right side of the operation door 8 and a notched portion on the front side of the right side plate 11, by holding a right side of the paper 1*a*.

The peripheral face of the folding bar 41 is formed smooth to slide the paper 1*a* easily on the peripheral face of the folding bar 41.

The wind-up portion 47, disposed within a rotational circle C of the winding rotational body 4 to contact the paper 1*a* wound by the winding rotational body 4 for giving wind-up force, is provided. The rotational circle C means a circle that parts of the winding rotational body 4 for winding the paper 1*a* (the folding bars 41) inscribe in rotation. To describe concretely, the (belt-shaped) wind-up portion 47 is suspended on a rear half of the rotational body 4 and in the rotational circle C to contact the paper 1*a* wound by the folding bars 41 for giving the wind-up force. Therefore, the wind-up portion 47 is well-stored in the main body, and not an obstacle to feeding of the paper 1*a*.

The wind-up portion 47 is, for example, made as that plural sheets of cloth (such as incombustible cloth) without entanglement of threads even when abraded are layered, and heat-welded by a high-frequency welding machine as to make lateral stripes (in crossing direction) as to make a concavo-convex wave pattern on a contact face with the paper 1*a* to increase contact pressure to the paper 1*a* for giving further-strong wind-up force.

A lateral width of the wind-up portion 47 is set to be smaller than the length of the folding bar 41, and the wind-up portion 47 is disposed within the length of the folding bar 41. Therefore, the wind-up portion 47 does not block the signal from the generator 44.

Vertical length of the wind-up portion 47 is set to be longer than the diameter of the rotational circle C as the folding bar 41 certainly contacts the wind-up portion 47 for a long time.

A weight 54 (of 3 to 10 grams) is attached to a lower end of the wind-up portion 47 to increase the wind-up force further. The weight 54 can be omitted. And, it is preferable to increase the wind-up force by 1 to 2 additional rotations of the rotational body 4.

An upper base end of the wind-up portion 47 is attached to a sliding plate 55 movable in back-and-forth direction to adjust a longitudinal position. To describe concretely, an adjusting lever 56 is attached to the sliding plate 55, and the sliding plate 55, for example, can be fixed on a desired longitudinal position as shown with a solid line and an imaginary line in FIG. 5 by hitching to and releasing from a hitching concavo-convex portion of an adjusting window portion 57 going through the right side plate 11 and the right fixation plate 13 of the main body. Therefore, the longitudinal position of the sliding plate 55 by operation of the adjusting lever 56 out of the main body.

Figure 5:
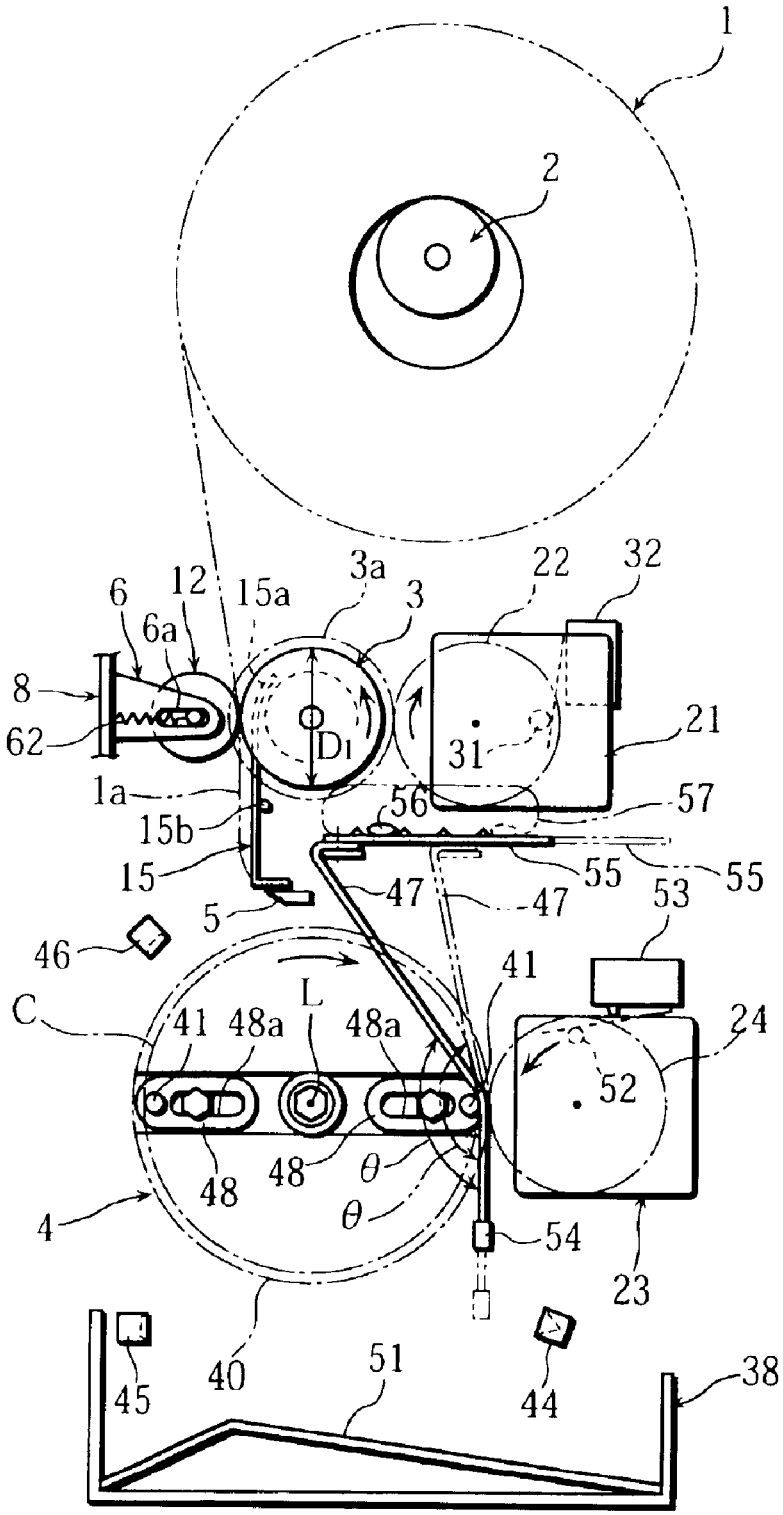
FIG. 5 is a working-explanatory view of a right side.

That is to say, as shown with the solid line in FIG. 5, when the wind-up portion 47 is fixed on a front position, a folding angle θ of the wind-up portion 47 on the folding bar 41 side is small, the contact pressure to the folding bar 41 increases, and the wind-up force becomes high. On the contrary, as shown with the imaginary line in FIG. 5, when the wind-up portion 47 is fixed on a rear position, the folding angle θ is large, the contact pressure to the folding bar 41 decreases, and the wind-up force becomes low. In short, the strength of the wind-up force can be regulated by position adjustment of the sliding plate 55 in longitudinal direction.

A paper-receiving tray 38, to stock the paper 1*a* sent out by the feeding roller 3, is disposed below the rotational body 4, and plural (5 in the present embodiment) metal wires 51, bent convex in side view, are disposed parallel on a bottom portion of the paper-receiving tray 38 with predetermined intervals (of 15 to 20 mm, for example). And, peaks of the metal wires 51 are situated slightly forward to the end of the suspended paper 1*a* to stock the paper 1*a*, inclined to be stocked in a front part of the paper-receiving tray 38, can be stocked properly in a rear part of the paper-receiving tray 38. Therefore, although water drops may fall near the opening portion 20 of the outer case 7 when the machine is handled by wet hands, the paper 1*a* does not get wet by fallen water drops for the metal wires 51. Further, the paper-receiving tray 38 is stored in the outer case 7 as to be drawn out to take out (clean) the water and dust accumulated on the bottom portion.

Next, working (function) of the present invention is described. This is a case in which the count setting portion 33 (refer to FIG. 1) is set to a folding number of 4 sheets (the minimum setting number).

Figure 3:
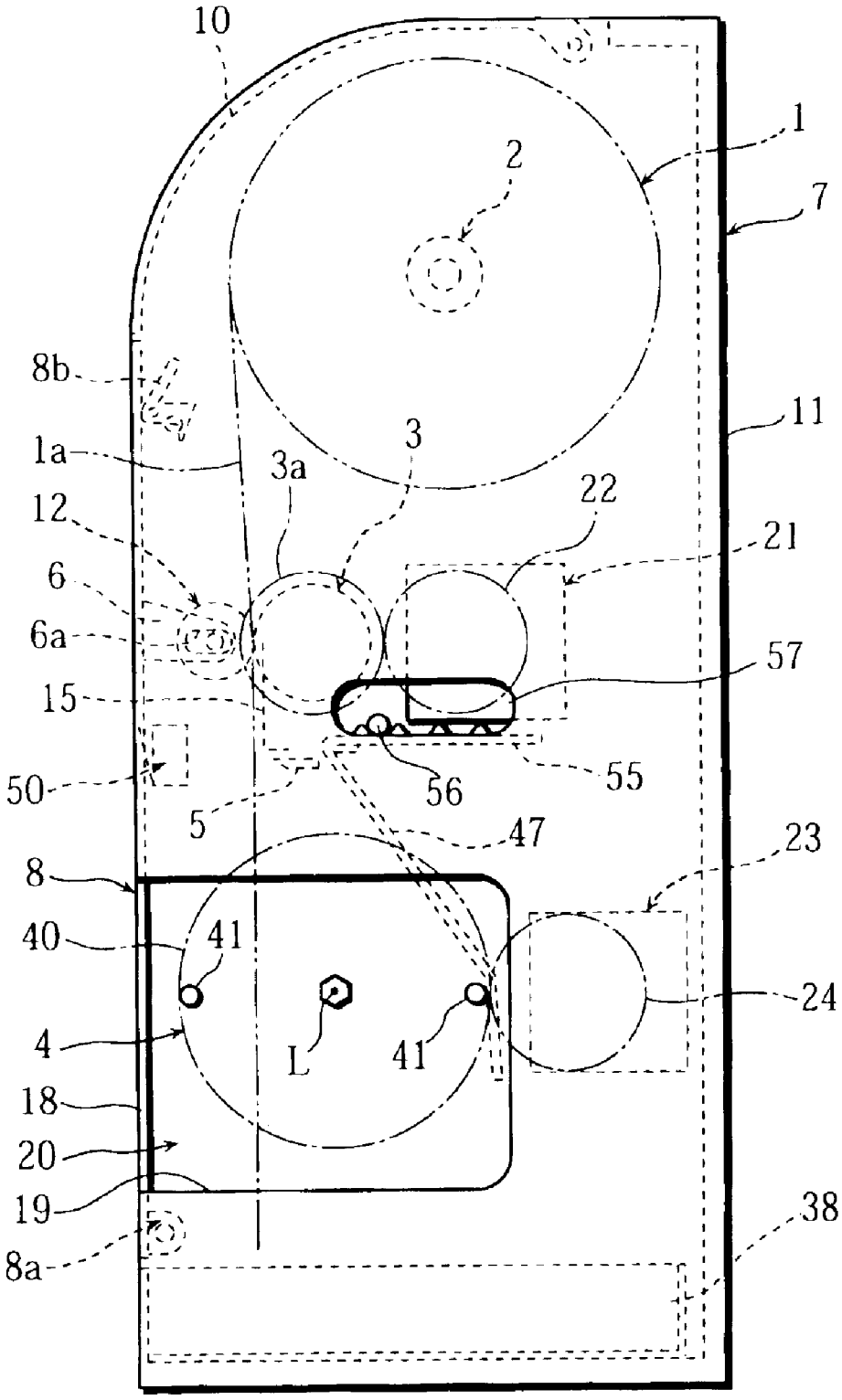
FIG. 3 is a right side view.
Figure 4:
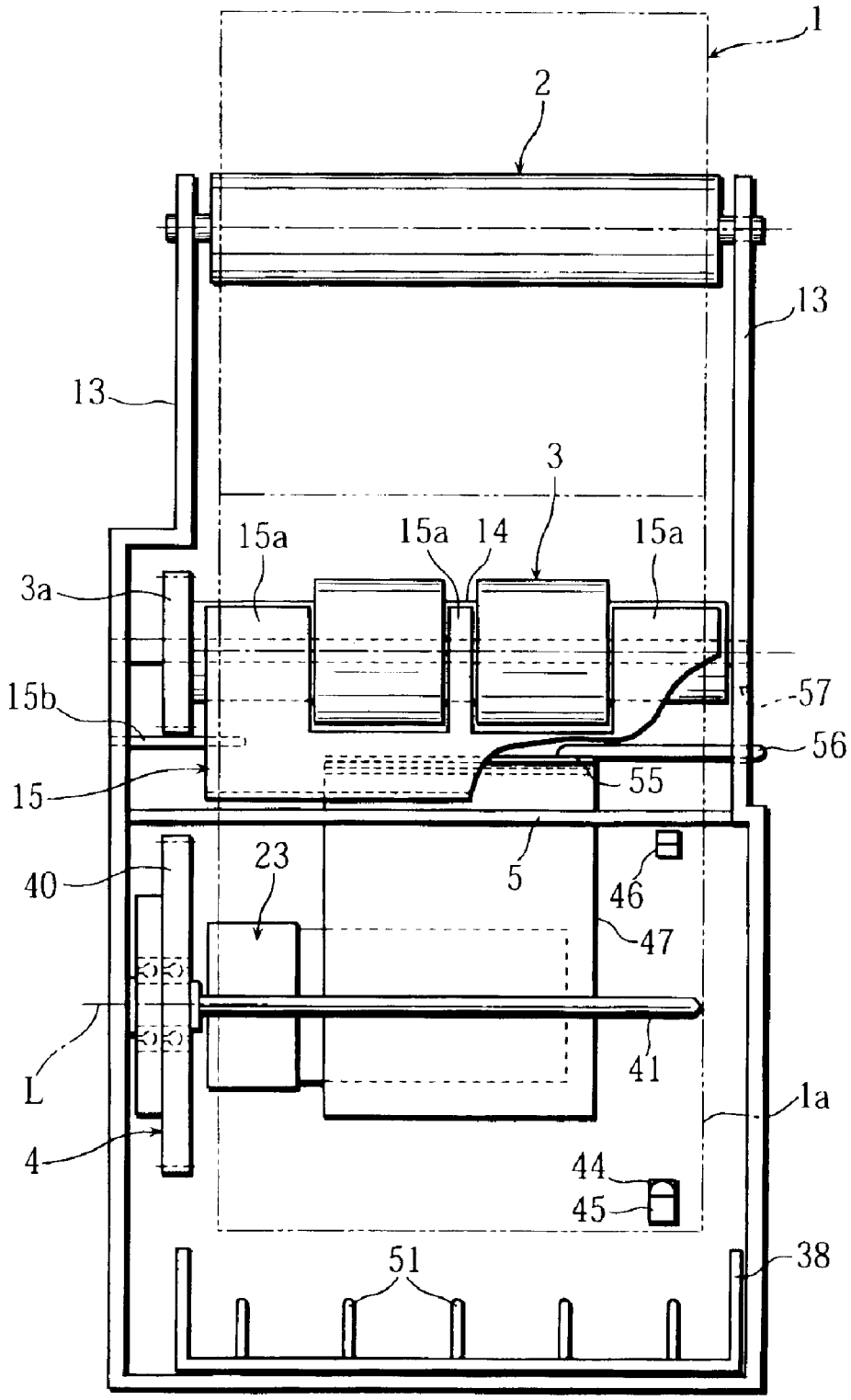
FIG. 4 is a front view showing a state in which an outer case is omitted.
Figure 8A:
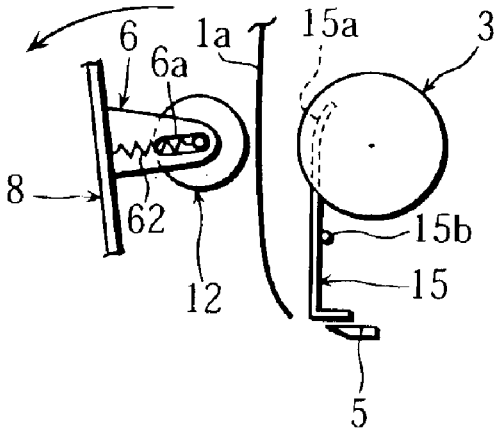
FIG. 8A is a working-explanatory view.

First, the operation door 8 shown in FIG. 3 is opened. In this case, the operation door 8 parts from a door switch 50 disposed behind the operation door 8, and the door switch 50 is "off" and entire power in the machine is cut off. Simultaneously, as shown in FIG. 8A, the aid roller 12 attached to the operation door 8 is parted from the roller 3. And, the paper 1*a* drawn out of the roll 1 is led between the roller 3 and the aid roller 12, through the a front face of the feeding guide 15, and suspended until the fixed cutting blade 5, then, the operation door 8 is closed. In this case, the paper 1*a* is held by the roller 3 and the aid roller 12 with appropriate pressure by the elastic force of the elastic member 62, and the door switch 50 is "on" simultaneously to put on the power of the machine to start.

Figure 8B:
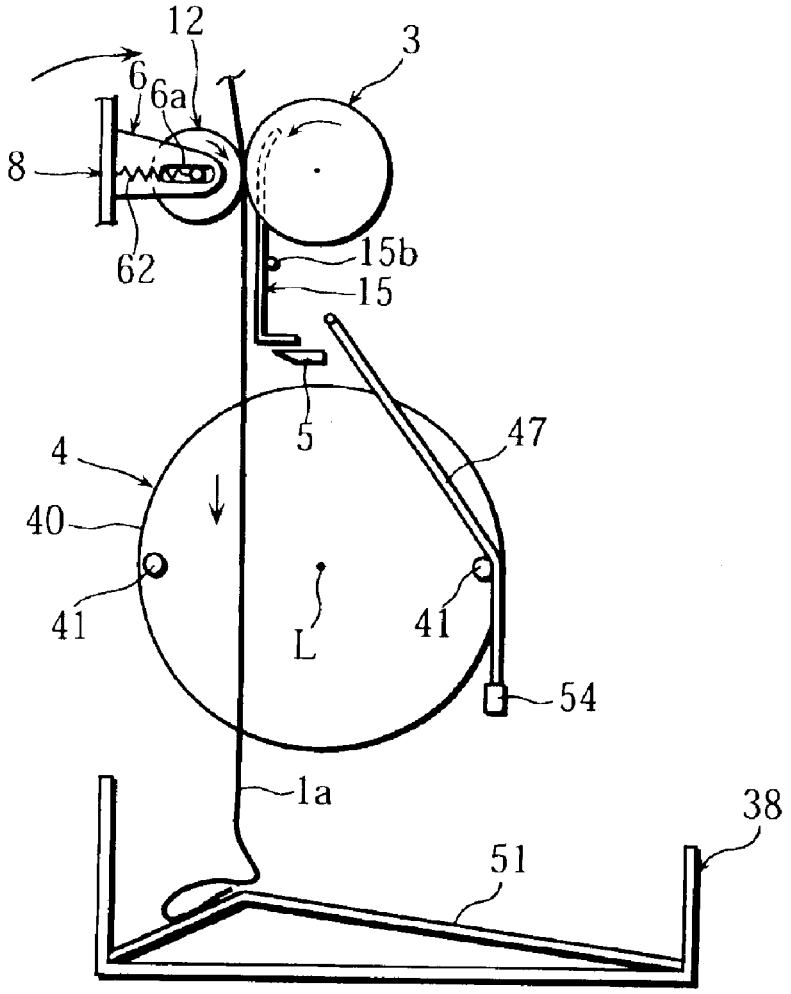
FIG. 8B is a working-explanatory view.

And, as shown in FIG. 8B, the paper 1*a* of the (set) predetermined length is held and drawn out by the roller 3 and the aid roller 12, led between the folding bars 41, and sent into (accumulated in) the paper-receiving tray 38.

Figure 9A:
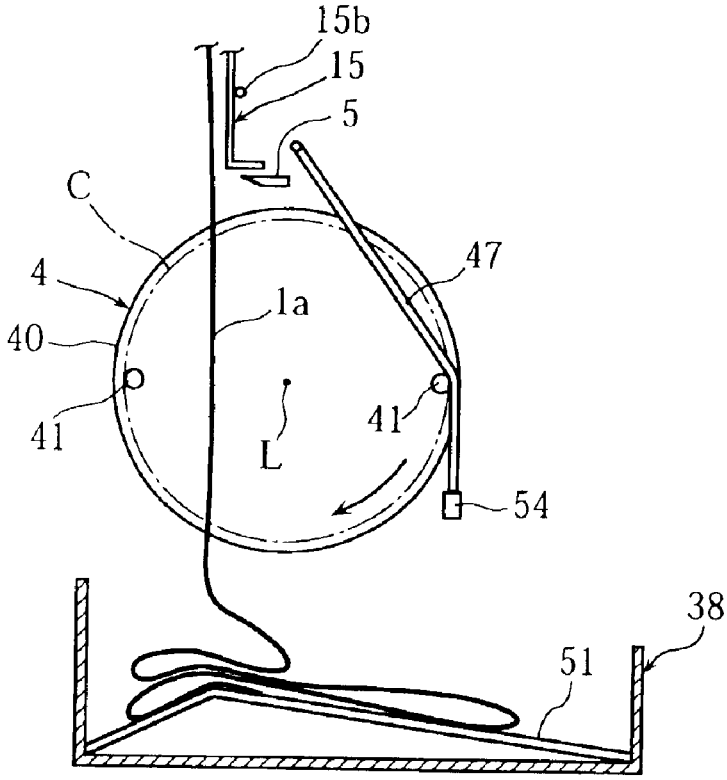
FIG. 9A is a working-explanatory view.
Figure 9B:
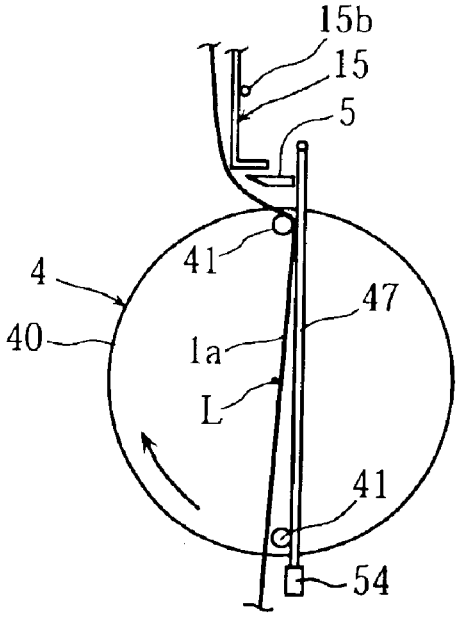
FIG. 9B is a working-explanatory view.

Then, the rotation of the roller 3 is stopped, when the rotational body 4 starts winding the paper 1*a* of the predetermined amount in a state that the folding bar 41 contacts the wind-up portion 47, each of the folding bars 41 contacts the front face and the reverse face of the paper 1*a* respectively as shown in FIG. 9B. In this case, the folding bar 41 is parted from the wind-up portion 47, and the wind-up portion 47 is suspended vertically.

Figure 10A:
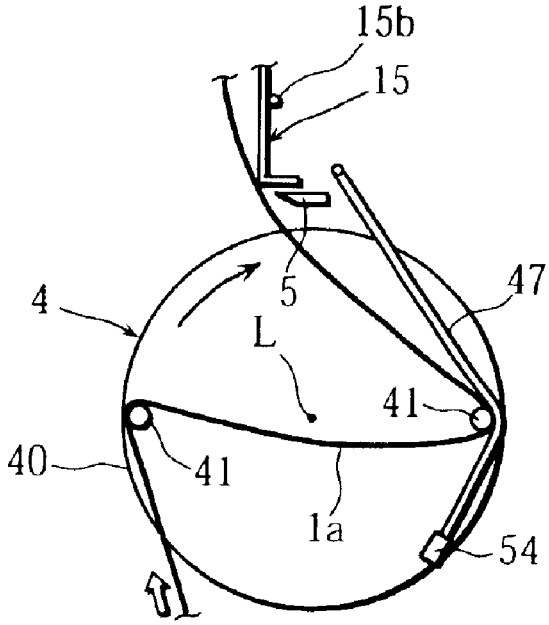
FIG. 10A is a working-explanatory view.

When the rotational body 4 is rotated further, as shown in FIG. 10A, the folding bars 41, sliding on the base end side of the paper 1*a*, wind from the forth end side of the paper 1*a* (in the paper-receiving tray 38. In this case, the paper 1*a* is tightly wound around the folding bars 41 because the wind-up portion 47 is bent L-shaped by inertia of the weight 54. Although the paper 1*a* contacts the feeding guide 15 on the lower side, the lower side of the feeding guide 15 is not oscillated backward because pressing force of the paper 1*a* is small.

Figure 10B:
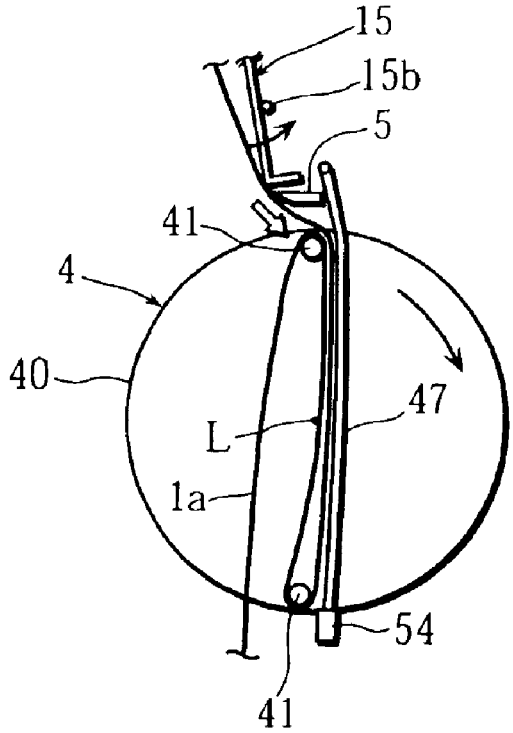
FIG. 10B is a working-explanatory view.

And, as shown in FIG. 10B, the paper 1*a* wound around the folding bars 41 contacts the base end portion of the paper 1*a* to pull the paper 1*a* above the rotational body 4 downward (by frictional resistance). In this case, the paper 1*a*, given the tensile force, contacts the lower portion of the feeding guide 15 with excessive pressing force, the lower portion of the feeding guide 15 oscillates backward around the shaft portion 15*b* to escape, and the paper 1*a* firmly contact the fixed cutting blade 5.

Figure 11A:
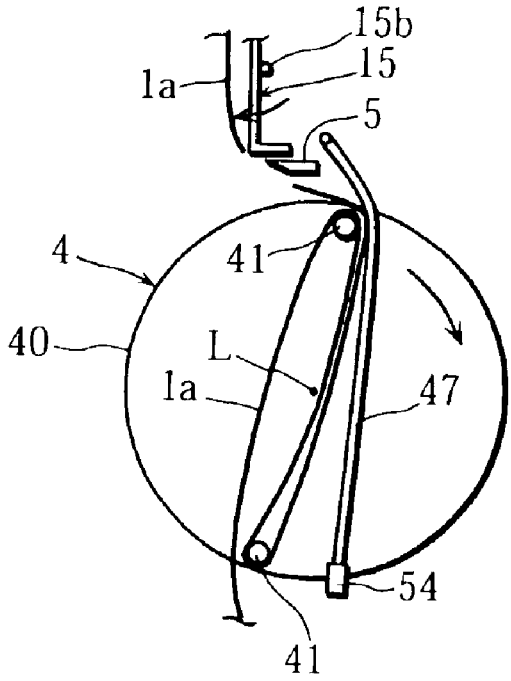
FIG. 11A is a working-explanatory view.

Then, as shown in FIG. 11A, the paper 1*a*, strongly pressed to the fixed cutting blade 5, is cut. In this case, even if fiber of the paper 1*a* above the fixed cutting blade 5 is entangled in the fixed cutting blade 5, this is released and the paper 1*a* of next process is easily fed because the lower side of the feeding guide 15 oscillates around the shaft portion 15*b* to return to its original position.

Figure 11B:
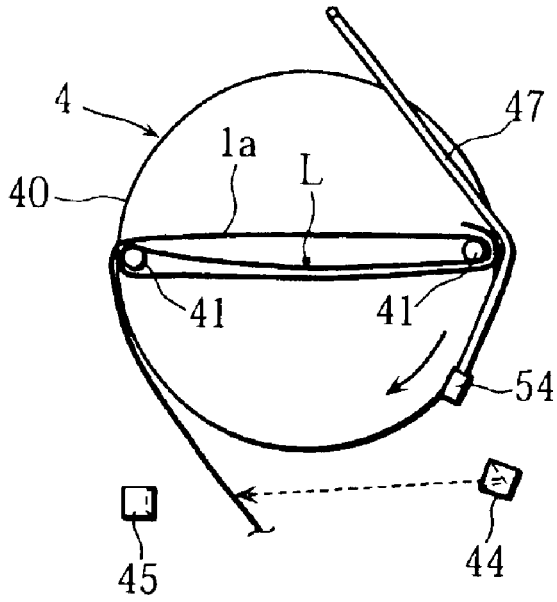
FIG. 11B is a working-explanatory view.
Figure 12A:
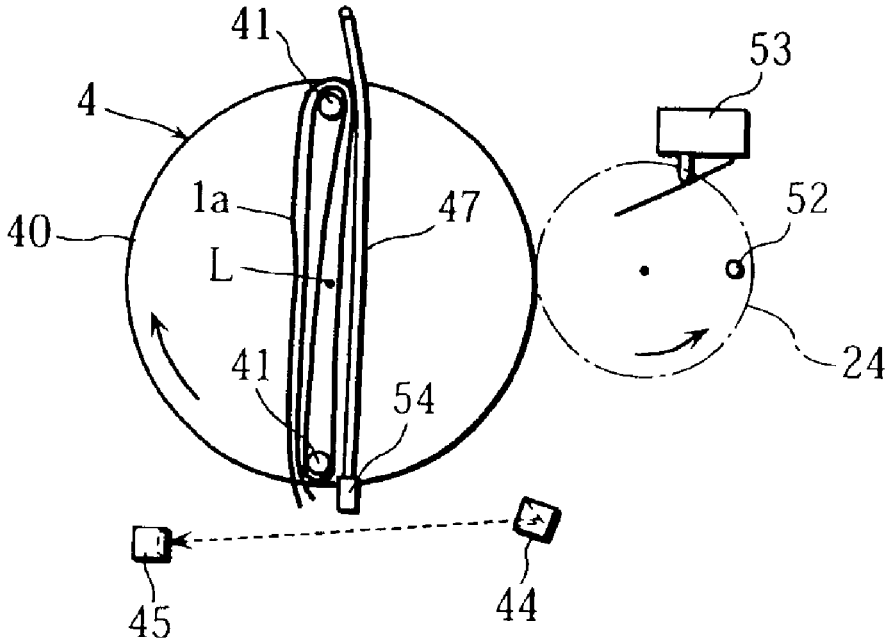
FIG. 12A is a working-explanatory view.
Figure 12B:
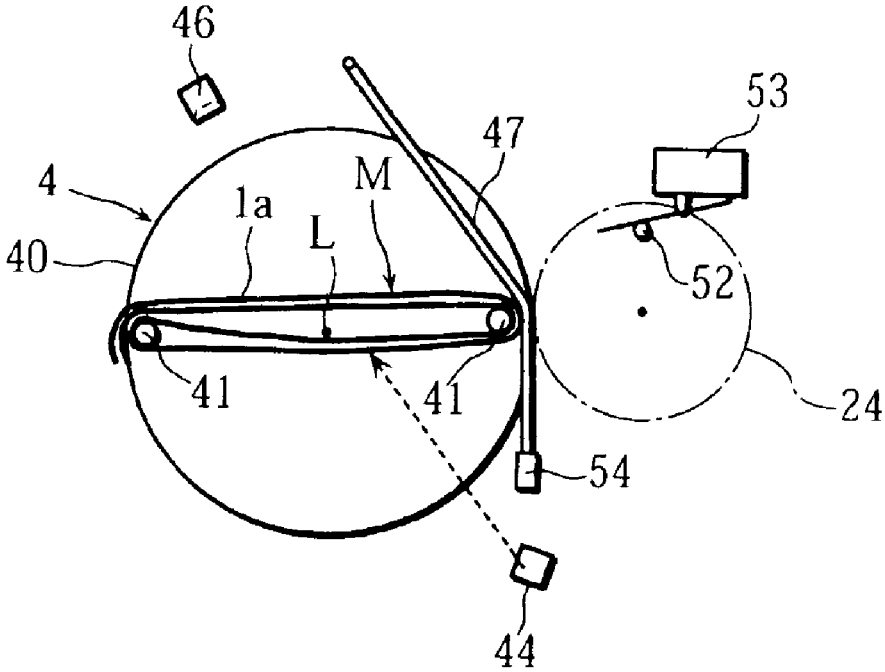
FIG. 12B is a working-explanatory view.

Then, the forward end side of the cut paper 1*a* is wound around the rotational body 4 as shown in FIG. 11B, the paper 1*a* is moved out of the space between the generator 44 and the receiver 45 as shown in FIG. 12A, the receiver 45 receives a signal from the generator 44 to detect that the paper 1*a* does not exist below the rotational body 4 (in the paper-receiving tray 38 and send a signal to the stopping switch 53, and the rotational body 4 is stopped as shown in FIG. 12B when the stopping dowel 52 pushes the stopping switch 53 just after the signal is received.

In this case, when the formed paper M is wound around the rotational body 4, the base end of the paper 1*a* can be adjusted by the wind-up portion 47. That is to say, when the wind-up portion 47 is placed on the front position, the base end of the paper 1*a* is led to the front side, and, when the wind-up portion 47 is placed on the rear position, the base end of the paper 1*a* is led to the rear side.

Figure 13A:
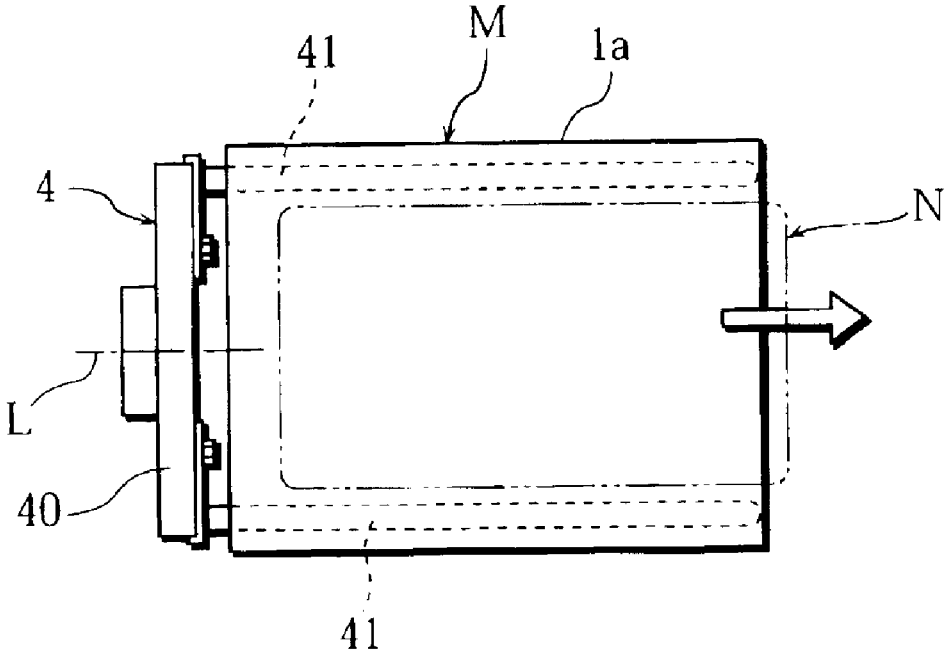
FIG. 13A is a working-explanatory view.
Figure 13B:
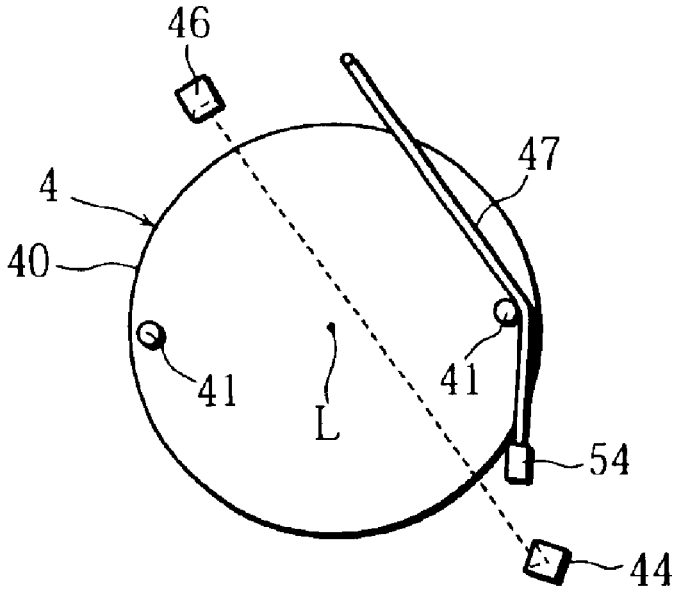
FIG. 13B is a working-explanatory view; portion.

And, a user inserts a hand into the opening portion 20 of the outer case 7 (refer to FIG. 1), holds a holding area N (between the folding bars 41) of the formed paper M (folded in four sheets) as shown in FIG. 13A, and pulls out of the rotational body 4 in the axis L direction. Then, as shown in FIG. 13B, the receiver 46 for starting the operation receives a signal from the generator 44, detects that the formed paper M is not on the rotational body 4 (in other words, the formed paper M is not between the generator 44 and the receiver 46), and immediately recommences the operation of the feeding roller 3 to form formed paper M anew. The formed paper M pulled out of the rotational body 4 is already folded flat and ready to use as shown in FIG. 14.

Figure 15:
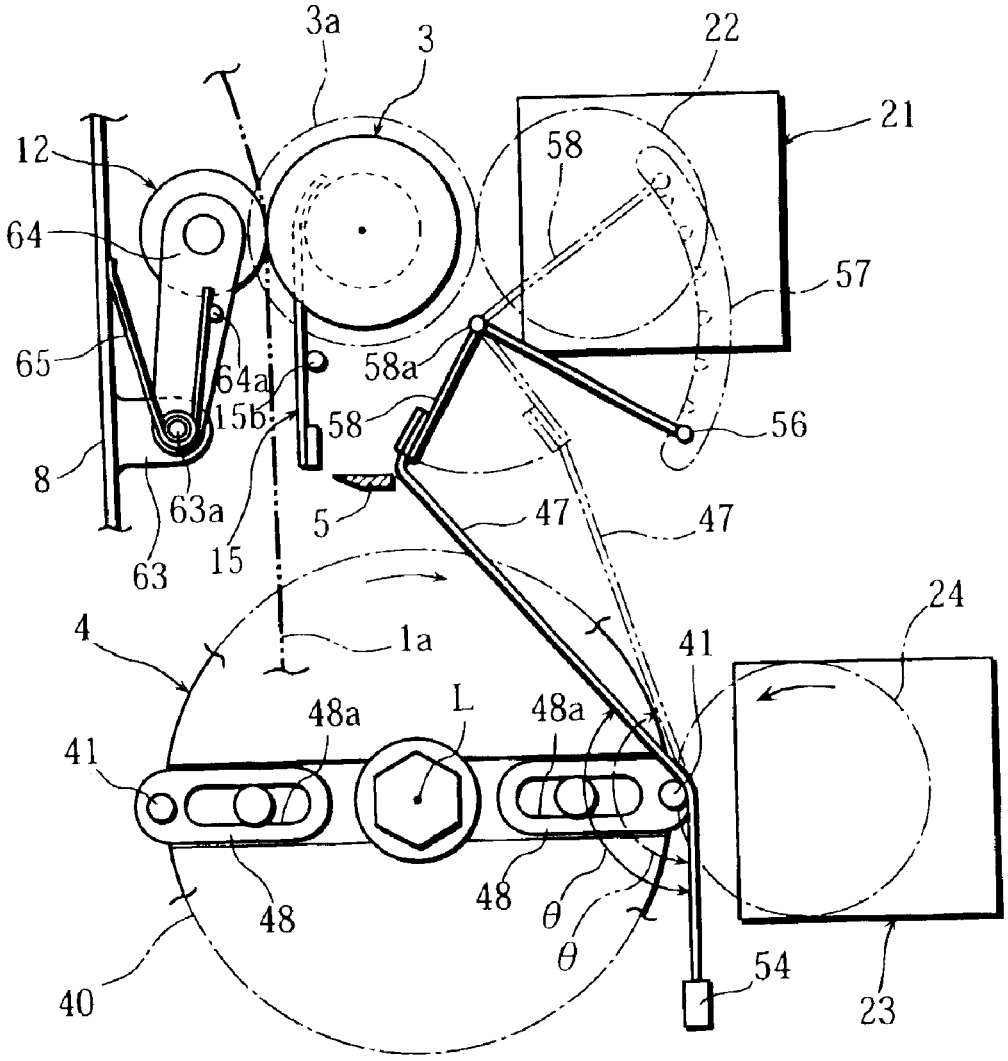
FIG. 15 is a working-explanatory view of a right side showing another embodiment of the present invention.

Next, FIG. 15 shows another embodiment of the present invention. The following construction is different as clearly shown in comparison with FIG. 5.

In FIG. 15, an oscillation board 58, L-shaped in side view, is provided, and, a shaft portion 58*a* is disposed on a bent portion of the oscillation board 58 and fixed to the fixation plate 13 as the oscillation board 58 oscillates around the shaft portion 58*a*. The wind-up portion 47 is attached to an end of the oscillation board 58, and the adjusting lever 56 is attached to another end of the oscillation board 58. The adjusting lever 56 can be hitched to and released from a hitching concavo-convex portion of the adjusting window portion 57. And, when the adjusting lever 56 is oscillated downward, the wind-up portion 47 oscillates forward. That is to say, wind-up force (bending angle θ) of the wind-up portion 47 is adjusted by oscillation of the oscillation board 58 around the shaft portion 58*a* as shown with imaginary lines and solid lines in FIG. 15. As described above, the oscillation board 58 for oscillation movement can be disposed on a position behind the fixed cutting blade 5.

And, in FIG. 15, the feeding aid roller 12 is connected to an end of a connection arm 64, another end of the connection arm 64 is connected to a shaft portion 63*a* of an attachment plate 63 attached to the rear face of the operation door 8, and the feeding aid roller 12 can be oscillated back and forth around the shaft portion 63*a* of the attachment plate 63. And, a scissors spring 65 is wound around the shaft portion 63*a* of the attachment plate 63, an end of the scissors spring 65 contacts the rear face of the operation door 8, another end of the scissors spring 65 contacts a small protruding portion 64*a* formed on the connection arm 64, and the scissors spring 65 elastically pushes the connection arm 64 as to oscillate backward. That is to say, the aid roller 12 is pressed to the feeding roller 3 by the elastic force of the scissors spring 65.

Figure 16A:
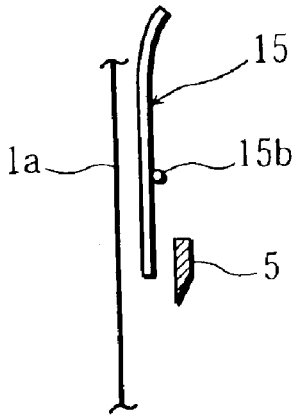
FIG. 16A is a working-explanatory view of a principal portion showing still another embodiment of the present invention.
Figure 16B:
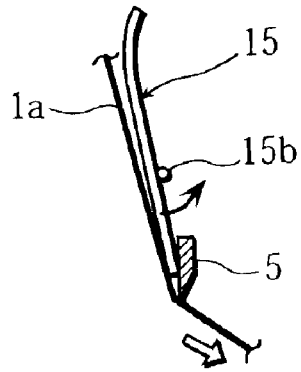
FIG. 16B is another working-explanatory view of the principal portion of the embodiment of FIG. 16A of the present invention.

Next, FIGS. 16A and 16B show still another embodiment of the present invention. The following construction is different as clearly shown in comparison with FIG. 5. That is to say, the fixed cutting blade 5 is disposed on a lower position behind the feeding guide 15 as the edge of the blade 5 is directed downward as shown in FIG. 16A, and when tension is given to the paper 1*a* as shown in FIG. 16B, the lower part of the feeding guide 15 oscillates backward, and the paper 1*a* is firmly pressed to the edge of the fixed cutting blade 5 to be cut. As described above, the members such as the wind-up portion 47 disposed behind the fixed cutting blade 5 are stored well (refer to FIG. 5 and FIG. 15) by the disposition of the fixed cutting blade 5 of which longitudinal direction in cross-section is vertical.

Figure 17A:
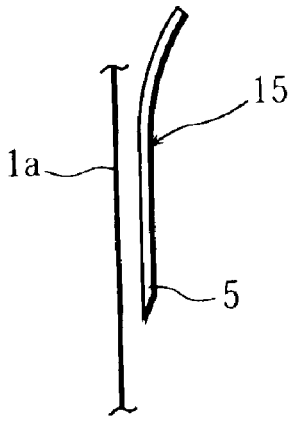
FIG. 17A is a working-explanatory view of a principal portion showing a further embodiment of the present invention.
Figure 17B:
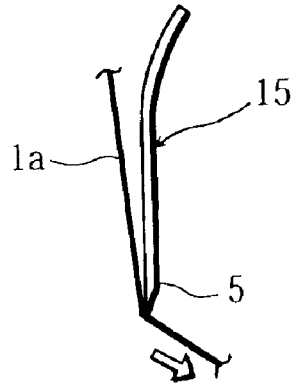
FIG. 17B is another working-explanatory view of the principal portion of the embodiment of FIG. 17A of the present invention.

Next, FIGS. 17A and 17B show a further embodiment of the present invention. The following construction is different as clearly shown in comparison with FIG. 5. That is to say, the fixed cutting blade 5 is formed unitedly with the feeding guide 15 on the lower end as the edge of the fixed cutting blade 5 is directed downward as shown in FIG. 17A, and the feeding guide 15 is fixed as not to oscillate. When tension is given to the paper 1*a* as shown in FIG. 17B, the paper 1*a* is firmly pressed to the edge of the fixed cutting blade 5 to be cut. As described above, production cost can be decreased and the members such as the wind-up portion 47 disposed behind the fixed cutting blade 5 are stored well further (refer to FIG. 5 and FIG. 15) because the lower end is formed as the fixed cutting blade 5.

Figure 18A:
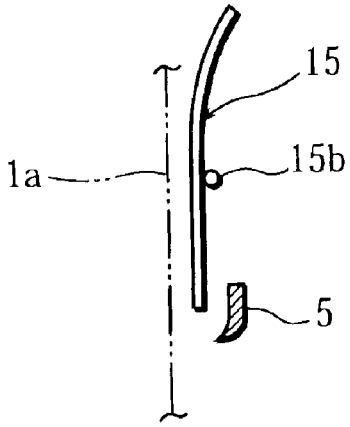
FIG. 18A is a working-explanatory view of a principal portion showing a still further embodiment of the present invention.
Figure 18B:
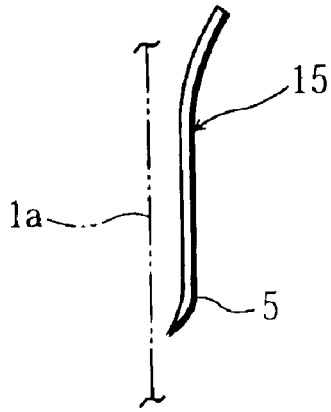
FIG. 18B is a working-explanatory view of a principal portion showing a still further embodiment of the present invention.

Next, FIGS. 18A and 18B show a further embodiment of the present invention. The fixed cutting blade 5 shown in FIG. 18A is different from the fixed cutting blade 5 shown in FIGS. 16A and 16B in that the edge is bent forward (toward the paper 1*a* side) to certainly cut the paper 1*a*. Similarly, the fixed cutting blade 5 shown in FIG. 18B is different from the fixed cutting blade 5 shown in FIGS. 17A and 17B in that the edge is bent forward. The edge of the fixed cutting blade 5 is bent as not to interfere the feeding of the paper 1*a* in the next process.

Figure 19:
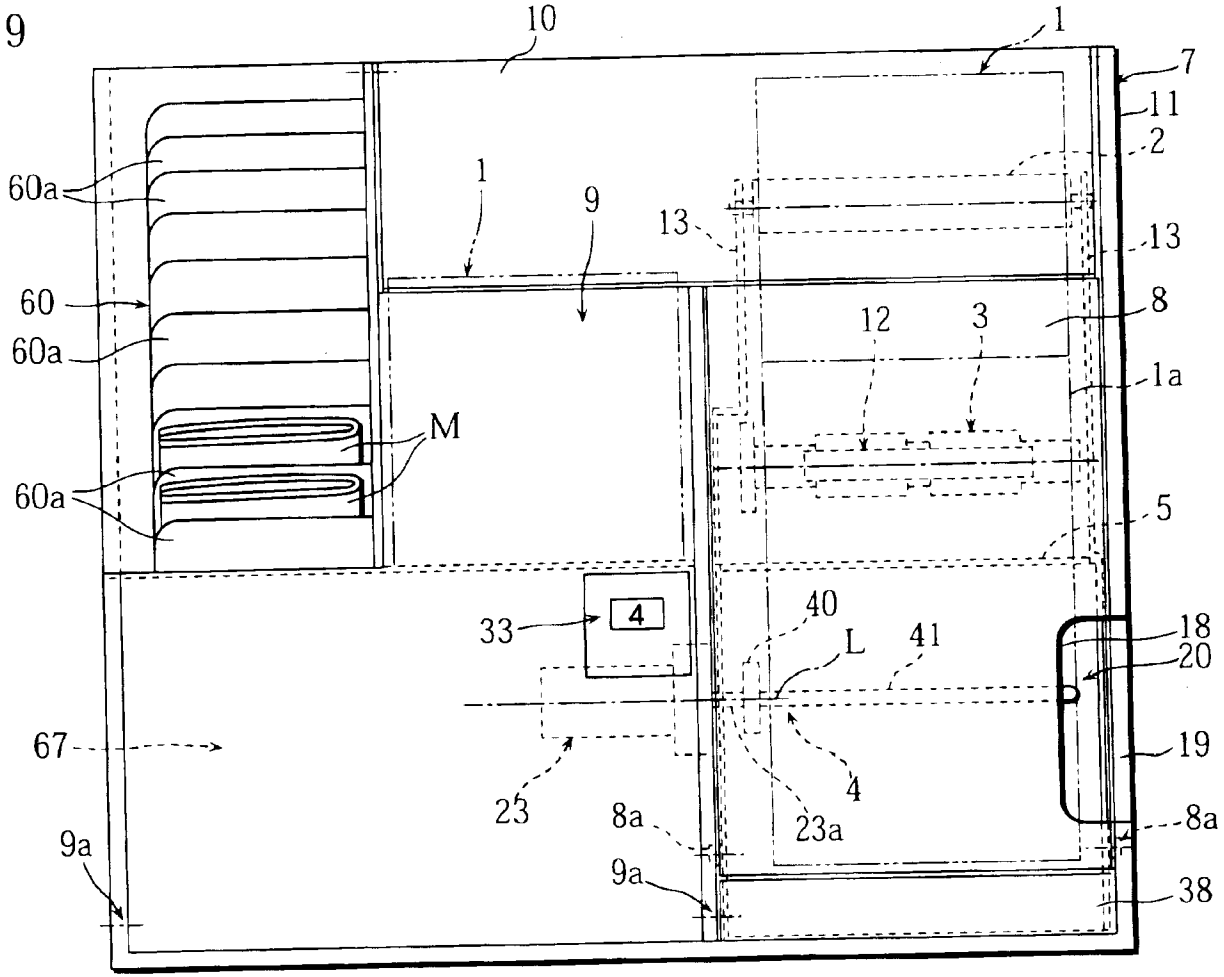
FIG. 19 is a front view showing another embodiment of the present invention.

Next, FIG. 19 is a front view to explain another embodiment instead of the above-described embodiment of FIG. 1, and FIGS. 20 through 22 show principal portions of FIG. 19. With these FIGS. 19 through 22, constructions different from the above-described embodiments are mainly described below.

As shown in FIG. 19, the folding motor 23 and the rotational body 4 (the rotation plate 40) are directly connected. That is to say, the folding motor 23 (with a reducer) is disposed in a control panel chamber 67 formed on a left lower position of the machine in FIG. 19, and, for example, the folding motor 23 is attached to the fixation plate 13 and the rotation plate 40 is directly attached to a motor output shaft 23*a* (as shown in FIGS. 19 through 23). The rotation plate 40 is (although formed circular in the embodiments described above) composed of an arm piece having a thin rhomboid configuration.

And, the stopping dowels 52 are attached to the rotation plate 40 as to protrude. The stopping switch 53 such as a limit switch and a photosensor to detect the stopping dowels 52 is, for example, attached to the fixation plate 13.

With this construction, parts such as the motor gear 24 (refer to FIG. 5) are omitted, the number of parts decreases, and the construction can be simplified and production cost can be reduced thereby. Further, an error that the paper 1*a* is accidentally entangled with the motor gear 24 in FIG. 5 can be prevented.

Figure 20:
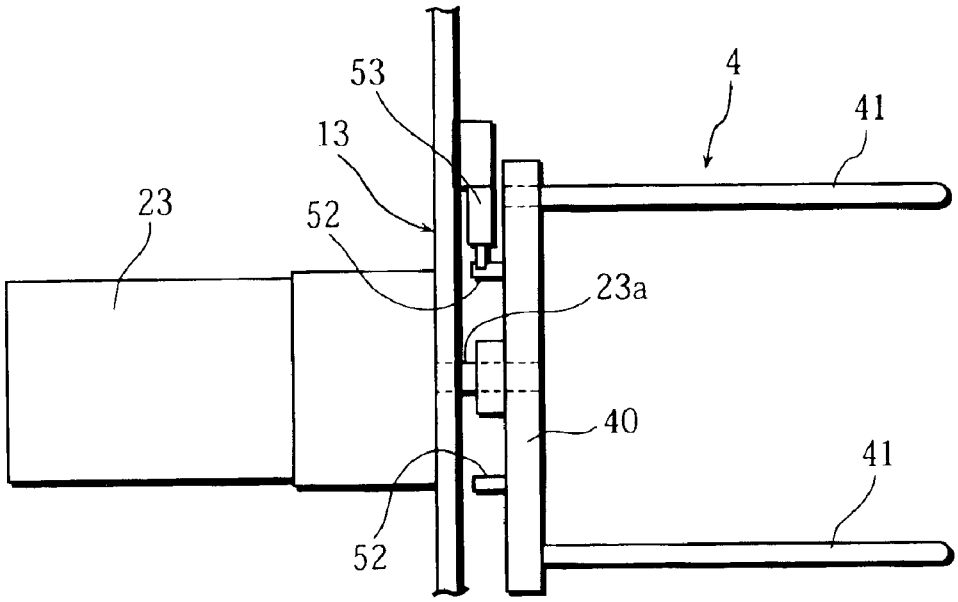
FIG. 20 is a top view of a principal portion.
Figure 21:
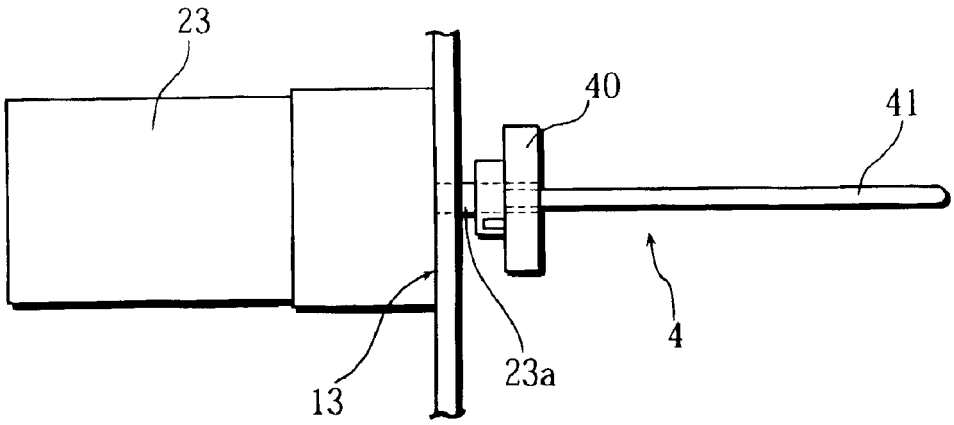
FIG. 21 is a front view of a principal portion.
Figure 22:
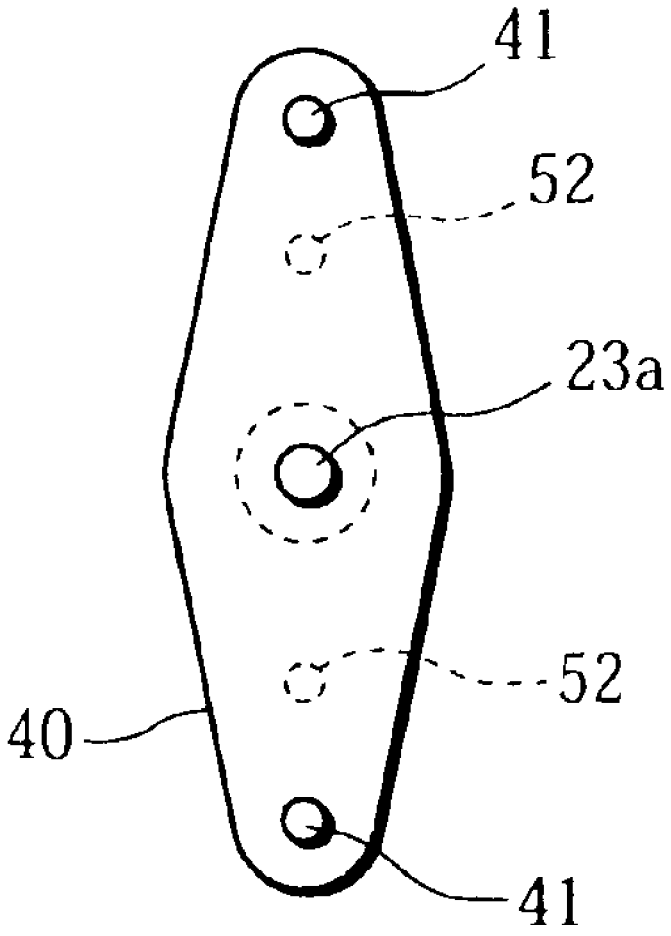
FIG. 22 is a side view of a principal portion.

As shown in FIGS. 20 through 22, it is preferable to apply the construction as shown in FIG. 7 when the rotational body 4 is directly attached to the output shaft 23*a* of the motor 23. That is to say, it is preferable to add a construction in which the two folding bars 41 come close to and part from each other.

In the present invention, not restricted to the embodiments described above, for example, the operation door 8 is detachable to facilitate checkup and repair. And, the operation of the machine may be started by a (separately provided) start button, or detecting conduction of weak voltage between the two folding bars 41. Further, the control of the rotation number of the feeding roller 3 may be timer control, the control of the rotation number of the winding rotational body 4 (namely, the end of the winding) may be counter control, timer control, or control by rotary encoder, and other modifications are possible within the scope of the present invention.

According to the winding and cutting machine for rolled paper of the present invention, the paper 1*a* of the predetermined length from the roll (of toilet paper) 1 is wound into flat and folded state of the predetermined folding width and number of sheets and cut, the flat and folded paper 1*a* is ready to use, handled by one hand, and easily used even by infants and people having handicapped hands. And, the paper 1*a* can be used with wet hands because the hands do not directly touch the roll 1, therefore, for example, used as useful and economical hand wiper in toilets neighboring swimming pools and public toilets, etc. Further, only the feeding roller 3 and the winding rotational body 4 may be provided with the driving means (such as a power unit and a transmission) which is not required for the fixed cutting blade 5, the construction of the machine is simplified, production cost can be reduced, and the control is made easy as a whole.

And, plural units of the formed paper M can be stored to use the formed paper M swiftly in need. This is preferable to users such as infants and elderly people. Further, the formed paper M stored in the stock case 60 can be easily taken out.

And, the formed paper M is prevented from being elliptic with bloated central parts by air resistance, and certainly made flat and folded for comfortable touch. And, the end edge of the formed paper M can be disposed on a predetermined position.

And, with simplified construction of the winding rotational body 4, the paper 1*a*, prevented from jamming and winding error, can be certainly wound to form the paper 1*a* flat and folded neatly.

Further, the folding width of the paper 1*a* (the formed paper M) wound by the winding rotational body 4 can be easily changed.

While preferred embodiments of the present invention have been described in this specification, it is to be understood that the invention is illustrative and not restrictive, because various changes are possible within the spirit and indispensable features.

What is claimed is:

1. A winding and cutting machine for rolled paper comprising a frame, a supply roll for holding rolled paper, a roller shaft attached to the frame extending through the roll for holding a roll for rotation, a motor driven feeding roller and a feeding aid roller operative to hold and draw selected lengths of paper from the roll, a rotatably mounted, motor driven winding rotational body disposed adjacent the feeding roller and oppositely from the supply roll, said winding rotational body being operable after a selected length of paper is drawn out from the supply roll and including adjustable means effective for winding and folding the drawn-out paper to selected flat lengths, and for holding such lengths, and a fixed cutting blade disposed between the feeding roller and the winding rotational body, wherein said adjustable means of the winding rotational body are effective for winding the paper within a rotational circle of the winding rotational body, and a wind-up portion defined by a flexible belt disposed with in the rotational circle of the winding rotational body to contact the drawn-out paper wound by the winding rotational body for giving wind-up force to the paper to provide tensile force to the paper being wound and folded and to press the paper to the fixed cutting blade after the drawn out paper has been wound and folded with a force to cut the paper into the selected length.

2. The winding and cutting machine for rolled paper as set forth in claim 1, wherein a stock case having plural shelf boards is provided, the plural shelf boards are disposed at locations wherein distance between adjacent shelf boards increases from a base end to a forward end or are disposed in parallel to form a storing portion, and formed paper, which is formed by the winding rotational body winding the paper of the predetermined length into a flat and folded state, is stored in the storing portion between the neighboring shelf boards.

3. The winding and cutting machine for rolled paper as set forth in claim 1 or claim 2, wherein the winding rotational body is provided with a rotation plate and two folding bars protruding from the rotation plate on positions symmetric with respect to a rotational axis of the rotation plate, wherein the paper placed between the two folding bars is wound into a flat and folded state, and means being provided to adjustably move the two folding bars to come close to and part from each other.

* * * * *